United States Patent [19]

Capawana

[11] Patent Number: 5,005,339

[45] Date of Patent: Apr. 9, 1991

[54] COIN ROLL BOXING APPARATUS

[76] Inventor: Ross Capawana, Las Vegas, Nev.

[21] Appl. No.: 479,768

[22] Filed: Feb. 13, 1990

[51] Int. Cl.[5] ..... B65B 57/20

[52] U.S. Cl. ..... 53/500; 453/56; 53/236; 53/531; 53/537

[58] Field of Search ..... 53/236, 246, 531, 537, 53/148; 198/457, 635, 407, 614, 468.11, 801, 954; 221/200; 453/55-58

[56] References Cited

U.S. PATENT DOCUMENTS

| | | | |
|---|---|---|---|
| 1,234,769 | 7/1917 | Champ | 198/468.01 |
| 1,793,613 | 2/1930 | Hoefling | 198/580 X |
| 3,445,986 | 5/1969 | Godet | 53/236 X |
| 3,447,707 | 6/1969 | Furst | 198/444 X |
| 3,515,260 | 6/1970 | Clyne | 198/801 X |
| 3,682,293 | 8/1972 | Kamp | 198/392 |
| 3,842,573 | 10/1974 | Price | 53/148 X |
| 3,866,388 | 2/1975 | Koehler | 53/236 X |
| 4,006,812 | 2/1977 | Everett et al. | 198/392 X |
| 4,036,355 | 7/1977 | Valli | 198/607 |

OTHER PUBLICATIONS

Undated brochure describing Brandt Automatic Coin Roll System.

*Primary Examiner*—Frank E. Werner
*Assistant Examiner*—Brian K. Dinicola
*Attorney, Agent, or Firm*—Quirk, Tratos & Roethel

[57] ABSTRACT

An apparatus for boxing coin rolls comprising a hopper feeding coin rolls to a rotary orienting feeder that discharges the coin rolls through a discharge chute. A conveyer belt system receiving the coin rolls and transporting the same to a manifold. A manifold bypassing apparatus is operative upon the manifold being filled with coin rolls to cause excess coin rolls to be returned to the orienting feeder for re-entry into the conveyor belt system until the filled manifold is emptied and ready to receive a new supply of coin rolls.

9 Claims, 5 Drawing Sheets

COIN ROLL BOXING APPARATUS

BACKGROUND OF THE INVENTION

This invention relates to an apparatus for loading paper tube wrapped coin rolls into boxes.

Banks, department stores, gambling casinos and many other types of business entities are required to dispense a large volume of coins of various dominations in the course of their operations. To facilitate the handling and accounting of the coins, the coins are supplied in paper tube wrappings. To further facilitate the handling and the accounting of the wrapped coins rolls, they are then packaged in standard size boxes. For example, fifty rolls of quarters will fill a standard size box. It is apparent that the manual packaging of a large number of coin rolls into boxes is an onerous labor intensive task.

There is currently available, however, a coin roll boxing apparatus having a roll feed mechanism for feeding a predetermined number of coin rolls into a manifold. The feed system in effect counts the number of rolls of coins to be dropped into the manifold and when the count reaches the predetermined number, the roll feed mechanism assumes, correctly or incorrectly, that the manifold has been filled and the roll feed stops automatically. In boxing the coin rolls, the operator then holds an empty box in front of the manifold and actuates a pusher mechanism for pushing the rolls of coin from the manifold into the box.

It is an object of the present invention to provide an improved coin roll boxing apparatus in which the coin roll feeding system can operate without interruption. That is, when the manifold is filled with the number of coin rolls required to fill a box, excess coin rolls are recirculated through the coin roll feeding system until the filled manifold has been emptied into a box and access to an unfilled manifold is available.

It is a further object of the invention to provide an improved coin roll boxing apparatus in which the manifold is exactly filled with the required number of coin rolls independently of any precounting of the coin rolls.

These and other objects of the invention will be apparent from the following disclosure of a preferred embodiment thereof.

SUMMARY OF THE INVENTION

The invention relates to a coin roll boxing apparatus in which paper tube wrapped cylindrical coin rolls are fed from a supply hopper to an orienting feeder that discharges the coin rolls through a discharge chute. A conveyer belt system receives the coin rolls from the feeder discharge chute. The conveyer belt system transports the coin rolls to a multi-pocket manifold where the coin rolls are dropped off into the manifold pockets. The apparatus includes a manifold bypass operative upon the manifold being filled with coin rolls. The manifold bypass causes excess coin rolls to be transported past the filled manifold and returned to the orienting feeder for re-entry into the conveyer belt system.

BRIEF DESCRIPTION OF THE DRAWINGS

The invention is best understood with reference to the drawings, in which.

DETAILED DESCRIPTION OF A PREFERRED EMBODIMENT

Figure 1:
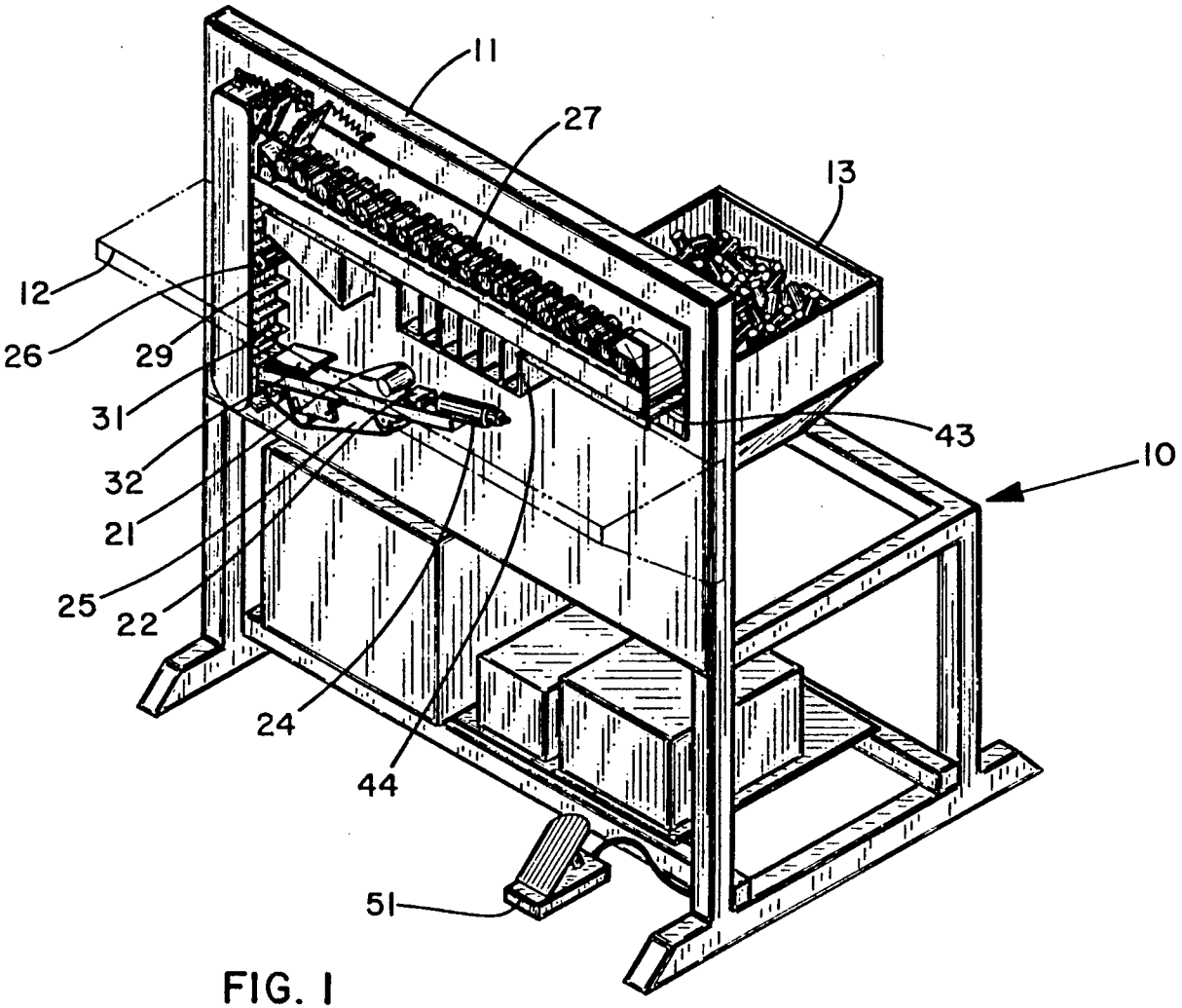
FIG. 1 is a perspective view of the coin roll boxing apparatus as seen from the side at which a coin boxing operator would stand.

Referring now first to FIG. 1, the coin roll boxing apparatus is mounted on a base 10. The base 10 has an upstanding panel 11 on the front side of which many of the components of the coin roll apparatus are mounted, as will be more fully explained. Shown in dotted outline is a shelf 12 for the use of the apparatus operator.

Figure 2:
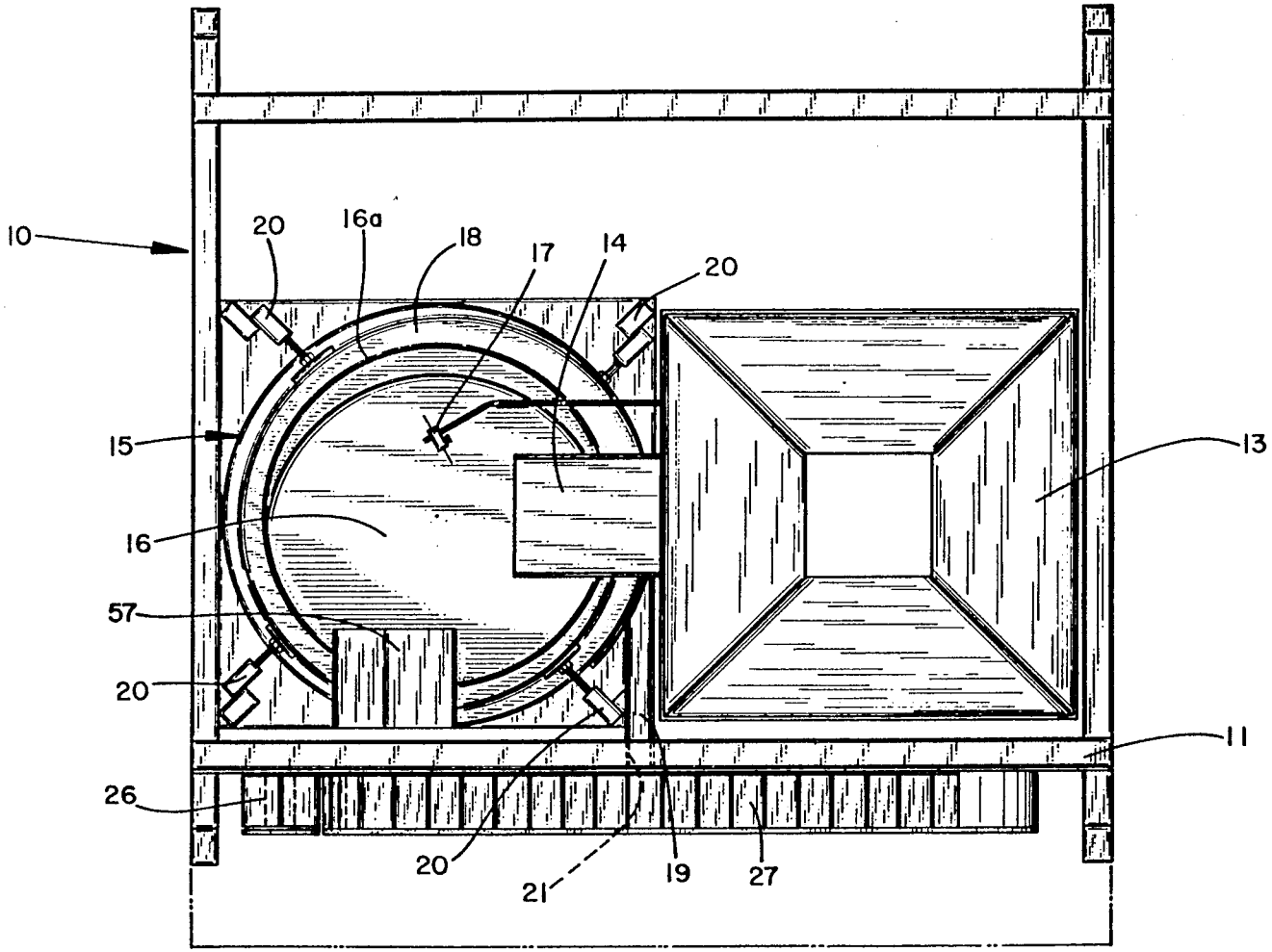
FIG. 2 is a plan view.

On the rear side of the panel 11, as partially seen in FIG. 1 and more fully in FIG. 2, is a storage hopper 13 having a vibratory discharge chute 14. The hopper 13 is adapted to be loaded with the paper tube wrapped cylindrical coin rolls that are to be boxed. The discharge chute 14 extends over a rotary orienting feeder 15. The coin rolls are fed by the vibratory discharge chute 14 of the hopper into the center chamber 16 of a vibratory rotary orienting feeder 15 of a commercially available type having a spiral ramp extending around the interior of the wall of the chamber 16. The level of coin rolls fed into chamber 16 is controlled by a level indicator 17 and if more than one level of coin rolls is indicated the vibratory motion of the discharge chute 14 is halted until the level indicator 17 indicates the chamber 16 can accommodate additional coin rolls.

In the vibratory rotary orienting feeder 15 the coin rolls roll from the bottom of the chamber 16 on to the spiral ramp 18. The coin rolls are moved incrementally up the ramp 18 in single file alignment by the intermittent vibratory movement of the spiral ramp 18 of the feeder 15. The duration of each increment of movement is controlled by biasing members 20 at the corners of the feeder. The biasing members yield to the incremental movement of the ramp 18 until a null point of the forward vibratory driving force is reached. At each null point or driving force point, the ramp 18 is caused to move rearwardly beneath the coin rolls causing the latter to be left in an incrementally advanced position on the ramp. Ultimately, each coin roll is moved upwardly into position to be fed into a discharge chute 19 that is aligned with an aperture 21 in the panel 11. Upon a coin roll being fed through the aperture 21 it comes to rest in abutting relation to a coin roll placement slide 22. The leading end of the coin roll abuts a switch 23 which activates a pneumatic pusher device 24 to propel the slide 22 toward a feed conveyer belt 25.

The feed conveyer belt 25 is part of the conveyer belt system that includes the feed conveyer belt 25, a vertical lift belt 26 and a substantially horizontal rotatable belt 27.

The slide 22 at the end of its travel deposits the coin roll upon the upper surface of the feed conveyer belt 25 and returns to its original position to receive the next coin roll from the discharge chute 19 of the rotary orienting feeder 15. The feed conveyer belt 25 carries the coin roll that was deposited on it by the coin roll placement slide 22 at a slight downward angle. The coin roll passes under a pair of brushes 28 whose function is to keep the coin roll from bouncing off the upper surface of the feed conveyer belt 25. The brushes 28 also ensure that the coin rolls are squarely seated on the belt 25 with the longitudinal axis of each coin roll perpendicular to the direction of movement of the belt.

Figure 3:
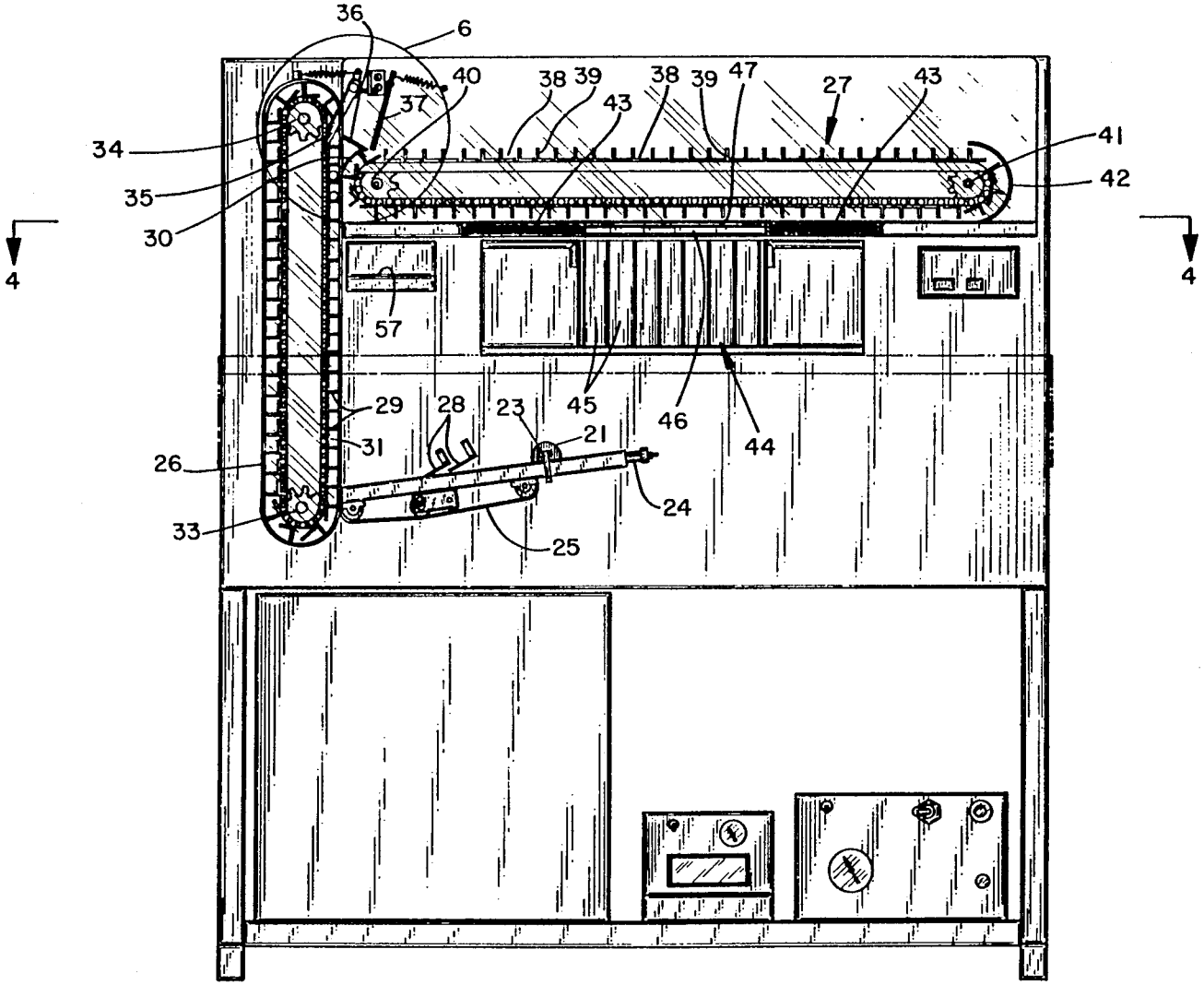
FIG. 3 is a front view of the apparatus.
Figure 6:
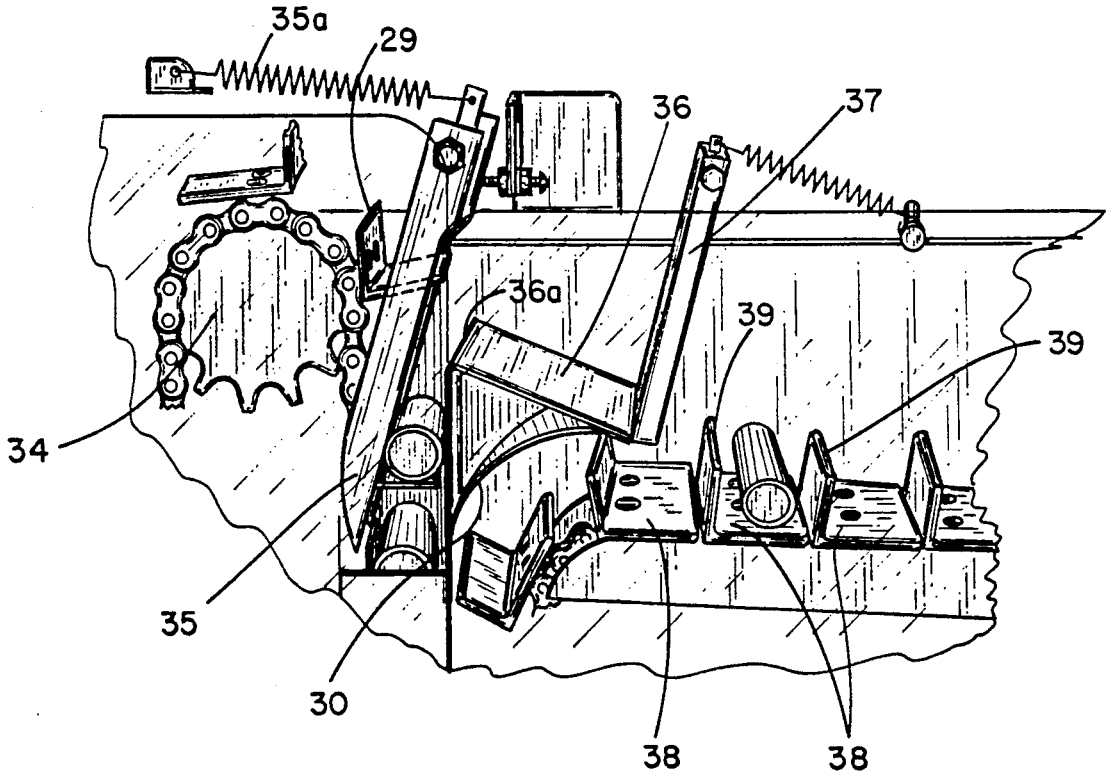
FIG. 6 is an enlarged view of the coin roll transfer mechanism taken within the circle 6 in FIG. 3.

The feed conveyer belt 25 that communicates with the vertical lift belt 26 which, as best seen in FIG. 3, is an endless belt having a plurality of spaced cleats 29 forming coin roll receiving pockets 31. The coin rolls from the feed conveyer belt 25 pass under a guide plate 32 into a receiving pocket 31 in which the coin roll is lifted from the gear toothed base pulley 33 to the head pulley 34. As each coin roll is carried upwardly toward the upper limit of its vertical travel, it engages the underside of deflector fingers 35 causing the latter to be swung in a clockwise direction, as viewed in FIG. 6, against the bias of a deflector spring 35*a*. As the coin roll reaches the forward edge 36*a* of a transfer chute 36 supported on its underside by a spring brace 30, the deflector finger 35 rolls the coin roll from the receiving pocket 31 to the transfer chute 36. After the coin roll is clear of the conveyer pocket 36 and is rolling on the chute 36, the spring 35*a* resets the deflector fingers 35 for engagement by the next coin roll on the vertical lift belt 26.

As the coin roll rolls down the transfer chute 36 it contacts a pivoted biased buffer 37 that slows the downward momentum of the coin roll so that it can drop into a receiving pocket 38 on the horizontally extending rotatable belt 27. The belt 27 is provided with a plurality of spaced cleats 39 which form the receiving pockets 38. When the cleats 39 are on the upper side of the rotating belt 27, the cleats 39 push the coin rolls from the base geared pulley 40 to the head pulley supporting the belt 27 for rotation. The end of the horizontally extending belt 27 receiving the coin rolls from the vertical lift belt 26 is considered the coin roll loading station for rotating belt 27. The point at which the horizontally extending belt 27 begins to turn over at the head pulley 41 is considered the unloading station for the rotatable belt 27 since this where the receiving pockets 38 begin to invert and to roll the coin rolls out of the pockets.

An arcuate guide 42 partially wrapped around the head pulley 41 end of the horizontally rotating belt 27 maintains the coin roll in contact with the receiving pockets 38 until the pocket is completely inverted. At this point the coin roll drops on to a trough 43 that extends beneath and parallel to the horizontally extending rotatable belt. Each coin roll is pushed along the trough 43 by a depending cleat 39 of the receiving pocket 38 from which the coin roll was dropped.

Supported on the panel 11 beneath the trough 43 is a molded plastic interchangeable coin denomination multi-pocket manifold 44. The manifold pockets 45 are open at the top and on the front and rear sides. The depth of the manifold from front to rear is equivalent to the length of a coin roll to be dropped therein. The width of each pocket is also equivalent to the diameter of the coin rolls to be accumulated therein. The manifold 44 can be changed to accommodate coin rolls of different lengths and diameters.

The trough 43 is provided with an access opening 46 overlying the top of the manifold 44. As the coin roll rolls along the trough 43 it will drop through the access opening 46 into a manifold pocket 45. This continues with additional coin rolls dropping into and filling up each manifold pocket until the manifold 44 is filled. Coin rolls in excess of those needed to fill the manifold 44 could roll over the tops of the coin rolls in the filled pocket to the continuation of the trough 43 on the other end of the access opening 46. Coin rolls rolling over the tops of coin rolls in the filled manifold, however, would interfere with the unloading of the manifold.

Figure 4:
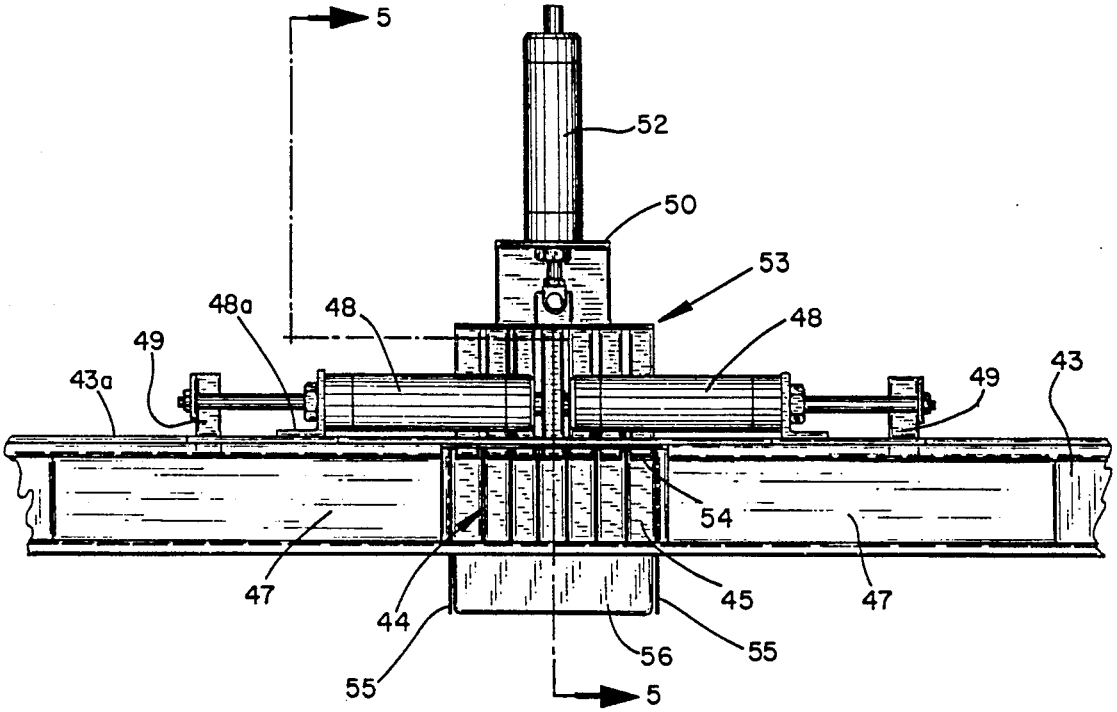
FIG. 4 is a partial plan view of the apparatus taken in the direction of the arrows 4—4 in FIG. 3.

As shown in FIG. 4, provision is made for bypassing the filled manifold after the manifold 44 is filled with coin rolls. Power actuated panels 47 can be moved to close the access opening 46 until the filled manifold 44 is emptied of the coin rolls therein. Movement of the panels 47 toward and from the center of the access opening 46 is controlled by opposed pneumatic cylinders 48. Each of the cylinders 48 is supported on a bracket 48*a* attached to a side wall 43*a* of the trough 43 and is coupled at 49 to a panel 47. When the manifold 44 is filled, the coin apparatus operator is required to initiate the series of events resulting in a transfer of the coin rolls from the filled manifold 44 to a coin box. The first step is to apply foot pressure to foot pedal 51 or other air pressure control valve for opening an air line to the pneumatic cylinders 48. This causes the panels 47 to move toward each other to fully close the access opening 46 over the top of the manifold 44.

Figure 5:
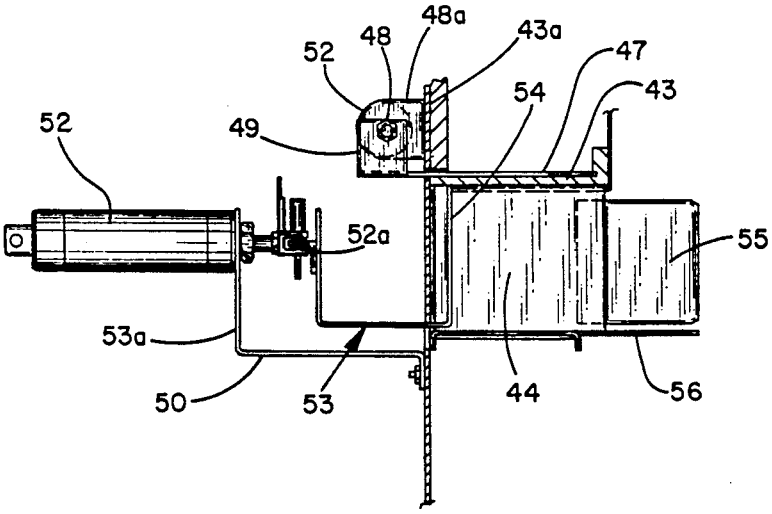
FIG. 5 is a partial section view taken on the line 5—5 of FIG. 4.

With the manifold access opening closed, a pneumatic cylinder 52 that is coupled at 52*a* to one leg 53*a* of a multi-finger pusher device, generally designated 53 as best seen in FIGS. 4 and 5 is actuated to move the pusher device, into the manifold 44. The pusher device 53 has a plurality of fingers 54 each of which is adapted to enter a manifold pocket 45. The fingers 54 are complementary to the pockets 45 in width and height. The pusher device 53 pushes all of the coin rolls out of the manifold 44 into an operator held box of a size complementary to the number of coin rolls in the manifold. Side and bottom guide panels 55 and 56 are provided to assist the operator in aligning the box to receive the coin rolls with the discharge side of the manifold.

With the access opening 46 to the manifold 44 closed, coin rolls being fed to the trough 43 will roll over the panels 47 toward the lift belt 26 end of the apparatus. Before reaching that end, however, the coin roll will drop through a return chute 57 in communication with the rotary orienting feeder 15 for ultimate discharge through the feeder discharge chute 19 and re-entry into the conveyer belt system by way of the feed conveyer belt 25.

After the filled manifold has been emptied, the pneumatic cylinder 52 is actuated to withdraw the fingers 54 from the manifold pockets 45 and the pneumatic cylinders 42 are actuated to retract the panels 47 and open the access opening 46 to the top of the manifold 44 for a new load of coin rolls.

While the invention has been described with respect to a preferred embodiment thereof, it will be readily apparent to those skilled in the art that certain modifications may be made within the spirit and scope of the invention. Accordingly, the invention should not be considered limited by the description of the preferred embodiment but should rather only be limited by the following claims.

I claim:

1. In a coin roll boxing apparatus in which cylindrical coin rolls are fed from a supply hopper to an orienting feeder that discharges the coin roll through a discharge chute, wherein the improvement comprises:

(a) a conveyer belt system receiving the coin rolls from the discharge chute;

(b) a manifold positioned to receive coin rolls from the conveyer belt system, and (c) a manifold bypass means including slidable panels movable into position to cover the manifold upon the manifold being filled with coin rolls, whereby excess coin rolls are permitted to pass over the manifold for return to the orienting feeder for re-entry into the conveyer belt system.

2. In a coin roll boxing apparatus according to claim 1, in which:

the slidable panels movable into position to cover the filled manifold are power actuated;

and a multi-fingered pusher device is actuatable to simultaneously load coin rolls from the filled manifold into a coin roll box after the manifold has been covered by the slidable panels.

3. In a coin roll boxing apparatus according to claim 1, in which:

the conveyer belt system includes a rotatable belt having a plurality of coin roll receiving pockets for transporting coin rolls to the manifold;

a trough underlying the rotatable belt has a manifold access opening therein;

the coin rolls are deposited from the rotatable belt on the trough for rolling movement into the manifold through the manifold access opening, and the manifold bypass means slidable panels are mounted adjacent the trough for movement into position to cover and uncover the manifold access opening after the manifold is filled with or emptied of coin rolls.

4. In a coin roll boxing apparatus according to claim 1, in which:

the conveyer belt system includes a horizontally extending rotatable belt having a plurality of spaced cleats extending the length thereof, the spaced cleats when on the upper side of the rotatable belt as the latter rotates forming upwardly opening coin roll receiving pockets;

a transfer mechanism for feeding coin rolls into the upwardly opening pockets for transport to an unloading station at which the upwardly opening pockets are inverted and the coin rolls are sequentially partially dropped out of the pockets;

a trough extending parallel to and beneath the rotatable belt on which the coin rolls from the inverted pockets are deposited for rolling movement toward the manifold, the trough having a manifold access opening therein through which the coin rolls can drop into the manifold when the access opening is uncovered.

5. A coin roll boxing apparatus comprising:

a coin roll supply hopper;

a rotary orienting feeder receiving coin rolls from the hopper;

the rotary orienting feeder axially feeding the coin rolls one at a time through a discharge chute;

a feed conveyer belt, a vertical lift belt and a substantially horizontal rotatable conveyer belt, coin roll placement slidable means receiving the coin rolls from the feeder discharge chute for transferring the same one after another to the feed conveyer belt, the feed conveyer belt transferring the coin rolls to the vertical lift belt, and the vertical lift belt lifting the coin rolls to the rotatable conveyer belt;

a trough located beneath and extending substantially parallel to the rotatable conveyer belt, the trough having a manifold access opening therein;

and a multi-pocket manifold positioned beneath the trough;

the rotatable conveyer belt depositing the coin rolls on the trough for rolling movement to the manifold access opening through which the coin rolls can drop into the manifold, and power actuatable panels slidable over the trough operable to open and close the manifold access opening in the trough, the panels when in closed position after the manifold is filled allowing excess coin rolls to move over the trough to a return chute to the rotary orientating feeder for re-entry into the conveyer belt system.

6. A coin boxing apparatus according to claim 5, in which:

a pusher device supported for movement transversely of the trough is operative when the access opening is closed to push all of the coin rolls out of the manifold into a coin roll receiving box.

7. A coin roll boxing apparatus according to claim 5, in which:

a transfer mechanism engages coin rolls being lifted by the vertical lift belt and transfers the coin rolls to the rotatable conveyer belt.

8. A coin roll boxing apparatus according to claim 7, in which:

the transfer mechanism comprises spring-loaded deflector fingers engageable by coin rolls carried on the lift belt, the coins coin rolls upon engagement with the deflector fingers being urged down a chute communicating with the rotatable conveyer belt and being deposited in a coin roll receiving pocket thereon.

9. A coin roll apparatus according to claim 8, in which:

the transfer mechanism includes a biased buffer device at the base of the chute for controlling the entry of the coin rolls into the coin roll receiving pockets on the rotatable conveyer belt.

* * * * *